United States Patent [19]

Maneke et al.

[11] Patent Number: 4,704,308

[45] Date of Patent: Nov. 3, 1987

[54] METHOD AND APPARATUS FOR MAINTAINING A GLUE APPLICATOR READY FOR OPERATION

[75] Inventors: Siegfried Maneke; Helmut Simon, both of Lengerich, Fed. Rep. of Germany

[73] Assignee: Windmöller & Hölscher, Lengerich, Fed. Rep. of Germany

[21] Appl. No.: 840,758

[22] Filed: Mar. 18, 1986

[30] Foreign Application Priority Data

Mar. 18, 1985 [DE] Fed. Rep. of Germany ..... 3509730

[51] Int. Cl.[4] ..... B05C 5/02; B05C 11/00; B05D 1/26

[52] U.S. Cl. ..... 427/207.1; 118/411; 118/302; 427/421

[58] Field of Search ..... 118/302, 410, 411; 427/421, 356, 207.1; 239/120; 222/148

[56] References Cited

U.S. PATENT DOCUMENTS

| | | | |
|---|---|---|---|
| 2,336,042 | 12/1943 | Smith | 118/302 X |
| 3,088,433 | 5/1963 | Walter et al. | 118/411 X |
| 3,299,854 | 1/1967 | Van Lobensels | 118/411 |
| 3,416,491 | 12/1968 | Turnbull et al. | 118/411 |
| 3,981,122 | 9/1976 | Johnson | 118/411 X |
| 4,542,710 | 9/1985 | Nakayama | 222/148 X |

*Primary Examiner*—John P. McIntosh

*Attorney, Agent, or Firm*—Fleit, Jacobson, Cohn & Price

[57] ABSTRACT

A method and apparatus for maintaining a glue applicator unit ready for operation after short or long term stoppages of a gluing operation. During short term stoppages, the applicator unit is pivoted away from the workpieces to which the glue is to be applied to a first rest position at which the nozzles are brought into tight engagement with a sealing means that includes a yieldable surface to surround and overlie the nozzles to provide an airtight seal. During long-term stoppages the glue applicators are pivoted beyond the first rest position to a second rest position at which the nozzles are in communication with a drain channel and purge fluid is sent through the applicator to pass through the nozzles and carry the glue and purge fluid to a collecting container, so that the nozzles are clear for subsequent start-up of the glue-applying operation.

10 Claims, 2 Drawing Figures

METHOD AND APPARATUS FOR MAINTAINING A GLUE APPLICATOR READY FOR OPERATION

BACKGROUND OF THE INVENTION

1. Field of the Invention

This invention relates to a method and apparatus for maintaining a glue applicator in condition for applying cold glue, which glue applicator includes a multiplicity of nozzle orifices, and more particularly to a method and apparatus for maintaining a glue nozzle in ready-to-flow condition and operable after both short and long stoppages of conveying apparatus that conveys the articles to which the glue is applied.

2. Description of the Prior Art

It is known to apply liquid glue to an area of predetermined size by means of glue-applying rollers or glue-applying nozzles. Glue-applying nozzles permit the glue to be applied in a more economical manner because they apply the glue in narrow stripes rather than over an entire surface. It is also known that glue can be applied to predetermined areas of webs or workpieces that are moved continuously past a stationary glue applicator that is provided with glue-applying nozzles, each of which nozzles is provided with a valve, preferably with a solenoid valve, to permit precise timing of the initiation and duration of the discharge of glue. However, when liquid glue is applied by means of nozzles, a serious problem can arise when the movement of workpieces is stopped because the nozzle orifices of the glue-applying nozzles can be clogged by glue that has set or solidified during the stoppage, so that resumption of glue flow is impeded when workpiece movement is resumed.

It is an object of the present invention to permit an application of glue by means of glue-applying nozzles in such a manner that clogging of the glue-applying nozzles with solidified glue does not arise during workpiece movement stoppages, so that that glue flow can be resumed immediately upon resumption of workpiece movement.

SUMMARY OF THE INVENTION

Briefly stated, in accordance with one aspect of the present invention, a method is provided for controlling a glue applicator to maintain it in free flowing condition for immediate dispensing after a short term shut-down of the conveying line that conveys the articles to which the glue is applied, the method including providing a stationary sealing surface made from yieldable material, and pivotally moving the glue applicator from a glue applying position in which the applicator nozzle is adjacent to a surface to which glue is to be applied, to a first rest position at which the glue nozzle is in contact with the sealing surface. The nozzle is moved against the sealing surface to cause the yieldable material to overlie and seal the orifice in the nozzle.

In accordance with another aspect of the present invention, a method for permitting long term shutdown of a glue applicator is provided, the method including providing an elongated drain receptacle and pivotally moving the glue applicator so that the nozzle is in communication with the drain receptacle, and then causing a purging fluid to pass through the glue applicator to cause glue and the purging fluid to issue from the nozzle into the drain receptacle and thereby prevent blockage of the nozzles by solidified glue.

In accordance with a further aspect of the present invention, apparatus is provided for maintaining a glue applicator in condition for glue dispensing, the apparatus including at least one glue applicator having at least one glue discharge nozzle, and means for supplying glue to the nozzle. Support means are provided for pivotally supporting the applicator to pivot about an axis of rotation toward and away from a surface to which glue is to be applied, the support means including a lever connected to the applicator and pivotally movable with the applicator from a glue-applying position to a first rest position away from the surface for short-term stoppage, and to a second rest position away from the surface for long-term stoppage. Sealing means are engageable with the glue-applying nozzle at the first rest position for closing the nozzle and preventing solidification of glue at the nozzle outlet. The sealing means includes a hinged flap valve. Purge means are provided for purging the nozzle of glue at the second position, and includes purge fluid supplying means for supplying purge fluid to the applicator, and receiving means for receiving glue and purge fluid at the second rest position, the receiving means including a drain channel cooperatively engageable with the nozzle to receive glue and purge fluid and to convey the glue and purge fluid to a collector.

DETAILED DESCRIPTION OF THE PREFERRED EMBODIMENT

An illustrative embodiment of the invention will now be explained in more detail with reference to the drawings.

Figure 1:
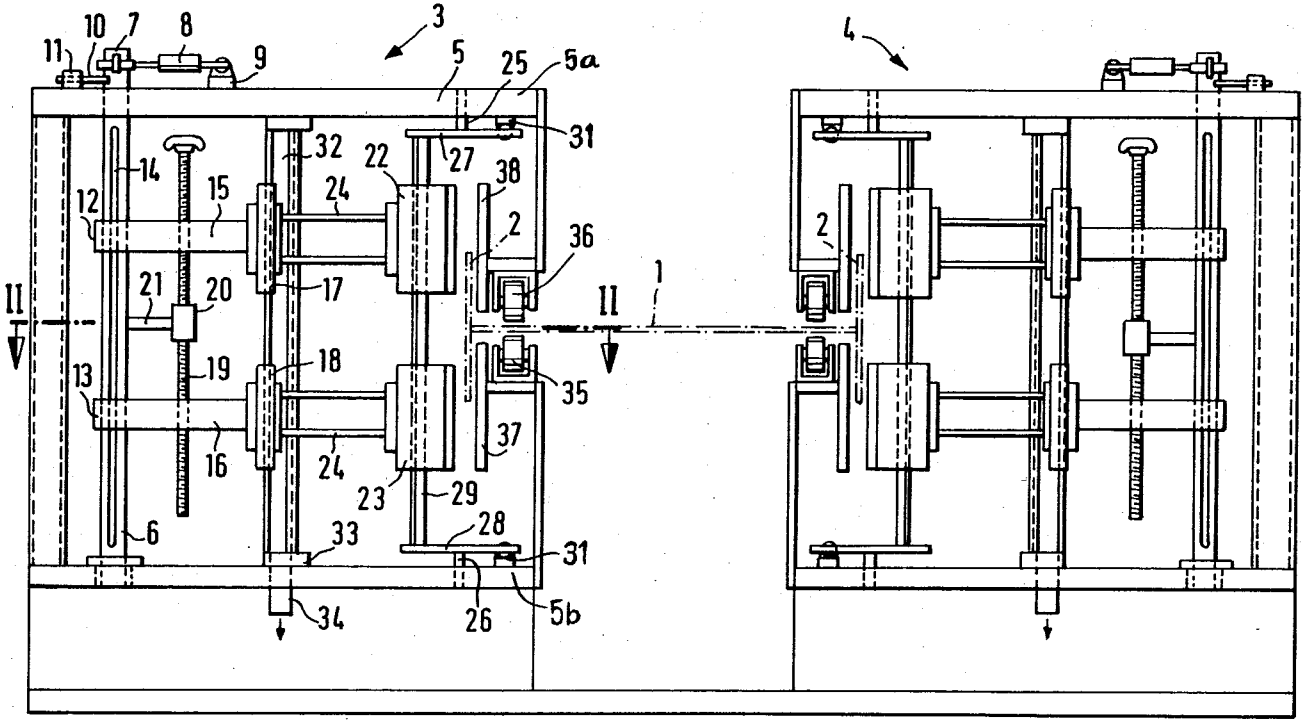
FIG. 1 is a diagrammatic end elevational view showing a sack conveying line including glue-applying apparatus for applying glue to vertically extending ends of sacks.

The apparatus shown in FIG. 1 for applying glue to the upfolded vertical ends 2 of continuously conveyed sacks 1 includes a left-hand glue applicator station 3 and a right-hand glue applicator station 4, which are arranged in mirror symmetry. Because the applicators are structurally the same, only the left-hand glue applicator station 3 will be described in detail.

The machine frame 5 includes upper and lower beams 5*a*, 5*b*, respectively, in which a vertically extending turning shaft 6 is rotatably mounted. A lever 7 extends outwardly from shaft 6 at right angles to the axis of the shaft and adjacent its upper end. The outer end of lever 7 is connected to the piston rod 8*a* of a pneumatic cylinder 8. Cylinder 8 is hingedly connected to a bracket 9 that is fixed to beam 5*a* of frame 5. Turning shaft 6 also carries a stop lever 10, which extends outwardly from and at right angles to the shaft 6 adjacent to lever 7 and which an operating position engages an abutment 11, which is fixed to beam 5*a* of frame 5. Bushings 12, 13 are axially slidably mounted on turning shaft 6 and include keys (not shown), which fit into an axial groove 14 formed on the outer surface of turning shaft 6. Levers 15, 16 are secured to the bushings 12, 13, respectively. Fittings 17, 18 are carried by the levers 15, 16 at their outer ends for connection to glue supply holes (not shown) and to hoses (not shown) for supplying purging fluid. The hoses extend from fittings 17, 18 to the glue applicators 22, 23, which are rigidly connected to the fittings 17, 18 by rods 24.

The levers 15 and 16 are provided with coaxially positioned tapped bores in threaded engagement with oppositely handed external screw threads of a screw 19. A threadless intermediate portion of the screw 19 is rotatably mounted in and axially fixed to a bushing 20, which is connected by a lever 21 extending outwardly from and secured to turning shaft 6. Rotation of screw 19 can be accomplished by turning handwheel 19*a* to cause levers 15 and 16 to move toward or away from each other, depending upon the direction of rotation of screw 19.

Figure 2:
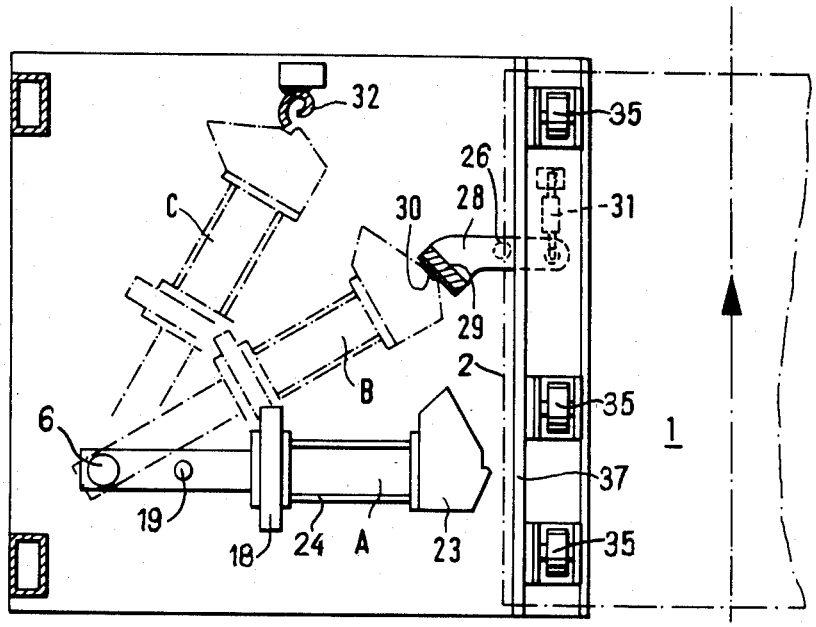
FIG. 2 is a cross-sectional view taken along the line II—II of FIG. 1.

Double-armed levers 27, 28 are pivoted to the machine frame 5 by means of pivot shafts 25, 26, respectively. Those arms of the levers 27, 28 which are on the left in the drawing are interconnected by a vertical carrier 29, which carries a valve flap or pad, which can be an elastic or yieldable seal in the form of a felt pad 30 as shown in FIG. 2. The felt pad 30 is preferably costed or impregnated with silicone oil. Pneumatic piston-cylinder units 31 are provided for imparting a pivotal movement to the levers 27, 28 and are connected to the other arms thereof to move the felt pad into position so that it contacts the glue applicators to thereby seal the glue nozzle orifices in an airtight manner. A vertically extending drain channel 32, which can be volute-shaped in cross-section, as shown in FIG. 2, is secured to the frame 5 at a point rearward and outward of vertical carrier 29, relative to direction of movement of the articles to be glued. At its lower end, the channel opens into a collecting container 33, which is provided with a drain port fitting 34.

In operation, the sacks 1 are conveyed along glue applicator stations 3 and 4 and extend through the frame 5 in a horizontal gap defined by vertically spaced conveyor rollers 35, 36, or defined by suitable conveyor belts (not shown). The sacks have ends 2 that extend vertically and adjacent to and in sliding contact with bearing plates 37, 38, that are positioned in vertically spaced relationship on opposite sides of the horizontal gap.

Referring now to FIG. 2, the glue applicator 23 is shown in different angular positions. The position identified by A is the operating position, shown in FIG. 2 in solid lines, corresponds with the position of those elements as shown in FIG. 1. In this position the glue nozzles are in position for applying stripes of glue to the ends 2 of sacks 1 that pass along bearing plates 37 and 38.

When the apparatus is stopped for a short period of time, and in order to avoid solidification of glue at the outlets of the respective nozzles of glue applicator 23, the glue applicator is pivoted about the pivot axis defined by shaft 6, and passes from operating position A to first rest position B, at which point the glue applicator has been moved away from bearing plate 37 and there is sufficient contact pressure so that the nozzles are in tight contact with felt pad 30 on the face of vertical carrier 29. During such a short term stoppage, lever 28 is in the position shown in FIG. 2, and sufficient resistance is provided by means of piston cylinder unit 31 to prevent glue applicator 23 from causing rotation of lever 28 about pivot 26. Thus the nozzles are moved into contact with the felt pad, which because of its elasticity or yieldable nature, surrounds and seals the nozzle outlets to thus prevent solidification of the glue at the outlets. Further, the application of silicone oil to the pad prevents adhesion thereto of the glue applicator nozzles. When operation of the apparatus is resumed, glue applicator 23 can be pivoted once again into its operating position A, and is thus ready for immediate glue dispensing without the need for removal of solidified glue. Although described only in terms of glue applicator 23, as will be apparent, glue applicator 22 moves together with glue applicator 23 by virtue of their connection to common turning shaft 6.

When the apparatus is shut down for prolonged period of time, glue applicator 23 is moved from its operating position A past first rest position B to second rest position C, as illustrated in FIG. 2. For such a long-term stoppage, piston cylinder unit 31 is activated to cause lever 28 to pivot clockwise about pivot 26, as viewed in FIG. 2, and thereby move vertical carrier 29, together with felt pad 30, out of the path of movement of the glue applicator to permit the latter to move into contact with vertically extending channel 32. As seen in FIG. 2, the outer portion of glue applicator 23 engages with the outermost edge of channel 32 to rest thereagainst, and the nozzles (not shown), are then in position for discharge into the interior of channel 32. At that point, a suitable purge fluid, which can be water if the glue is water soluble, is introduced into the nozzle unit 23 under pressure to purge the glue therefrom, and the glue and purge fluid issue from the nozzles into channel 32 which, because of its volute shape, retains the glue and purge fluid interiorly thereof and permits it to fall vertically along the channel into collecting container 33 as shown in FIG. 1, for collection. As a result, the glue applicator will be in condition for operation when the apparatus is started up again, because the glue no longer is in a position to clog the nozzles. The positioning of the outer edge of the volute cross-section can be such that the outer side wall is approximately tangential to the axes of the glue nozzles when the glue applicator is in position C, to thereby avoid splashing of the purging fluid, which will impinge on the side wall and will be deflected inwardly along a spiral path.

As will be apparent to those skilled in the art, each of glue applicators 22 and 23 can have a series of vertically aligned nozzles to permit glue to be applied in a controlled manner in the form of a series of spaced strips on a predetermined area of the upstanding sack ends 2. Further, the relative vertical positions of glue applicators 22 and 23 can be shifted toward and away from each other by rotating screw 19 by means of handwheel 19*a*, or the like, which, depending upon the direction of rotation of the screw, causes glue applicators 22 and 23 either to move toward each other, for sacks in which the upstanding vertical ends are relatively short, or they can be moved away from each other in the event that the upstanding sack ends are of a larger size.

Although particular embodiments of the present invention have been illustrated and described, it will be apparent to those skilled in the art that changes and modifications can be made without departing from the spirit of the present invention. It is therefore intended to cover in the appended claims all such changes and modifications that fall within the scope of the present invention.

What is claimed is:

1. A method for maintaining a glue applicator having a glue nozzle in condition for immediate glue dispensing after a short term shutdown of a glue-applying operation, said method comprising:

(a) providing a stationary sealing surface made from yieldable material;

(b) pivotally moving the glue applicator from a glue-applying position in which the applicator nozzle opposes a bearing plate and is adjacent to a desired surface to which glue is to be applied, away from the desired surface and the bearing plate to a rest position wherein the glue nozzle is spaced from the desired surface and is in contact with the sealing surface; and (c) continuing to move the nozzle unit against the sealing surface with sufficient contact pressure to cause the yieldable material to overlie and seal the nozzle.

2. A method according to claim 1, including the step of coating the sealing surface with silicone oil.

3. A method for maintaining a glue applicator having a glue nozzle in condition for immediate glue dispensing after a long term shutdown of a glue-applying operation, said method comprising:

(a) providing an elongated and substantially vertically extending drain receptacle;

(b) pivotally moving the glue applicator from a glue-applying position in which the applicator nozzle is adjacent to a surface to which glue is to be applied, to a rest position at which the glue nozzle is in communication with the drain receptacle; and (c) causing a purging fluid to pass through the glue applicator to cause the glue and purging fluid to issue from the nozzle into the drain receptacle.

4. A method according to claim 3 wherein the glue is a water soluble glue and the purging fluid is water.

5. Apparatus for maintaining a glue applicator in condition for glue dispensing, said apparatus comprising:

(a) at least one glue applicator including at least one glue discharge nozzle;

(b) means for supplying glue to said glue discharge nozzle;

(c) support means for pivotally supporting said applicator to pivot about an axis of rotation for movement toward and away from a desired surface to which glue is to be applied, said support means including a lever connected to said applicator, said lever pivotally movable to move said applicator from a glue-applying position to a first rest position away from said desired surface for short-term stoppage, and to a second rest position away from said surface for long-term stoppage;

(d) sealing means engageable with the glue discharge nozzle at said first rest position for closing the nozzle and for preventing solidification of glue in the nozzle outlet, said sealing means including a hinged valve flap and engageable with said nozzle;

(e) purge means for purging said nozzle of glue at said second position, said purge means including purging fluid supply means for supplying purging fluid to said applicator; and (f) receiving means for receiving glue and purge fluid at said second rest position, said receiving means including a drain channel cooperatively engageable with said nozzle to receive glue and purge fluid and for conveying the glue and purge fluid to a collector.

6. Apparatus according to claim 5, wherein said valve flap includes a yieldable pad engageable with said nozzle.

7. Apparatus according to claim 6, wherein said pad is a felt pad and said pad is impregnated with silicone oil.

8. Apparatus according to claim 5, wherein said glue applicator includes a plurality of glue discharge nozzles arranged in a vertical row, and said glue applicator lever is pivoted to move about a vertical axis.

9. Apparatus according to claim 5, wherein said drain channel extends vertically and is volute-shaped in cross section and includes an outer wall defining one edge of an opening facing the glue applicator, said outer wall being substantially tangent to an arc described by said nozzle as it is pivoted from said glue-applying position to said second rest position.

10. Apparatus according to claim 5, wherein said apparatus includes two substantially parallel mounting arms for carrying respective glue applicators, an externally threaded shaft having oppositely handed screw threads at respective ends thereof and having its axis parallel to said glue applicator pivot axis, said mounting arms including respective internal screw threads in threaded engagement with respective threaded portions of said threaded shaft, and supporting means for supporting said threaded shaft for pivoting movement about the glue applicator pivot axis with said mounting arms, said glue applicators being movable toward and away from each other by rotation by said threaded shaft.

* * * * *